United States Patent [19]

Furuya

[11] 4,379,466

[45] Apr. 12, 1983

[54] COUNTING DEVICE FOR COIN SORTING AND COUNTING MACHINE

[75] Inventor: Katusuke Furuya, Tokyo, Japan

[73] Assignee: Laurel Bank Machine Co., Ltd., Tokyo, Japan

[21] Appl. No.: 212,539

[22] Filed: Dec. 3, 1980

[30] Foreign Application Priority Data

Dec. 29, 1979 [JP] Japan ..... 54/182586[U]

[51] Int. Cl.[3] ..... G07D 9/04

[52] U.S. Cl. ..... 133/3 C; 133/8 R

[58] Field of Search ..... 133/3 R, 3 D, 3 E, 8 R, 133/3 C; 194/100 A, 100 R

[56] References Cited

U.S. PATENT DOCUMENTS

| | | | |
|---|---|---|---|
| 3,012,649 | 12/1961 | White et al. | 194/100 R |
| 3,026,982 | 3/1962 | Buchholz et al. | 133/3 R |
| 3,079,934 | 3/1963 | Thompson | 133/8 |
| 3,090,390 | 5/1963 | Jones | 133/8 |
| 3,147,839 | 9/1964 | White, Jr. | 194/100 R |
| 3,173,431 | 3/1965 | Chichester et al. | 133/3 R |
| 4,261,377 | 4/1981 | Ueda | 133/3 D |

FOREIGN PATENT DOCUMENTS

| | | |
|---|---|---|
| 45-34084 | 11/1970 | Japan . |
| 54-25798 | 2/1979 | Japan . |
| 55-34472 | 9/1980 | Japan . |

*Primary Examiner*—Stanley H. Tollberg

*Attorney, Agent, or Firm*—Fleit, Jacobson & Cohn

[57] ABSTRACT

Herein disclosed is a counting device for use in a coin sorting and counting apparatus including a coin path for moving coins to be sorted and for guiding the same such that the coins being moved change their courses and leave the coin path in succession at predetermined positions according to the sizes or diameters of the coins. Further included is a coin feeding mechanism for feeding the coin path with the coins one by one. The counting device has a plurality of vibrating elements arranged at the respective positions, where the coins leave the coin path, so that they are vibrated by the coming coins, respectively, when they come into contact. A plurality of vibration sensors are connected with the vibrating elements, respectively, for converting the vibrations of the elements into electric signals. As customary, the calculating means receives the electric signals for separately calculating the numbers and sums of the coins of different sizes.

5 Claims, 5 Drawing Figures

COUNTING DEVICE FOR COIN SORTING AND COUNTING MACHINE

BACKGROUND OF THE INVENTION

1. Field of the Invention

The present invention relates to a counting device for use in a coin sorting and counting apparatus.

2. Description of the Prior Art

Generally speaking, a coin sorting and counting apparatus is so devised that various kinds of mixed coins supplied into a hopper are fed one by one and moved along a coin (or sorting) path and are guided, while moving, to their respective courses and leave the coin path in succession in accordance with their sizes, whereby the coins are classified in accordance with their diameters and are stored in the containers for the different sized coins.

In a counting device for use in the aforementioned coin sorting and counting apparatus, more specifically, the counting operations of the coins sorted are performed by photoelectric detectors, which are arranged in the vicinities of the inlets of respective chutes, when the coins are poured into the chutes.

However, the aforementioned photoelectric detectors are remarkably vulnerable to malfunction caused by dust, and the micro-switches are sometimes unreliable in their operations so that an erroneous count may result.

SUMMARY OF THE INVENTION

The present invention has been conceived in view of the background thus far described and contemplates providing a coin counting device which can count the coins sorted accurately and reliably.

According to a major feature of the present invention, there is provided a counting device for use in a coin sorting and counting apparatus including a coin path for moving coins to be sorted and for guiding the same such that the coins being moved change their courses and leave said coin path in succession at predetermined positions according to the sizes of said coins, and a coin feeding mechanism for feeding said coin path with said coins one by one, said counting device comprising: a plurality of vibrating elements arranged at the respective positions, where said coins leave said coin path, which are vibrated by the coming coins, respectively, when the latter comes into contact with the former; a plurality of vibration sensors connected with said vibrating elements, respectively, for converting the vibrations of said vibrating elements into electric signals; and calculating means responsive to said electric signals for separately calculating the numbers of the coins of different sizes.

BRIEF DESCRIPTION OF THE DRAWINGS

Other objects and advantages of the present invention will become apparent from the following description made in conjunction with the accompanying drawings, in which.

DESCRIPTION OF THE PREFERRED EMBODIMENT

Figure 1:
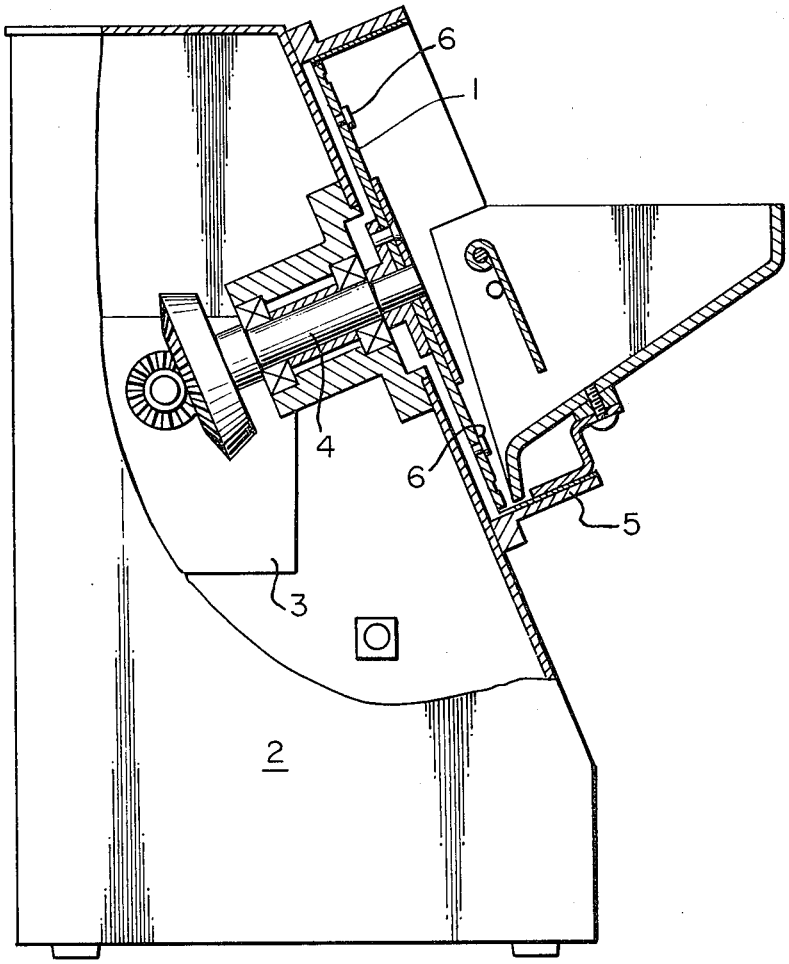
FIG. 1 is a partially broken front elevated view showing an essential portion of the embodiment of the present invention.
Figure 2:
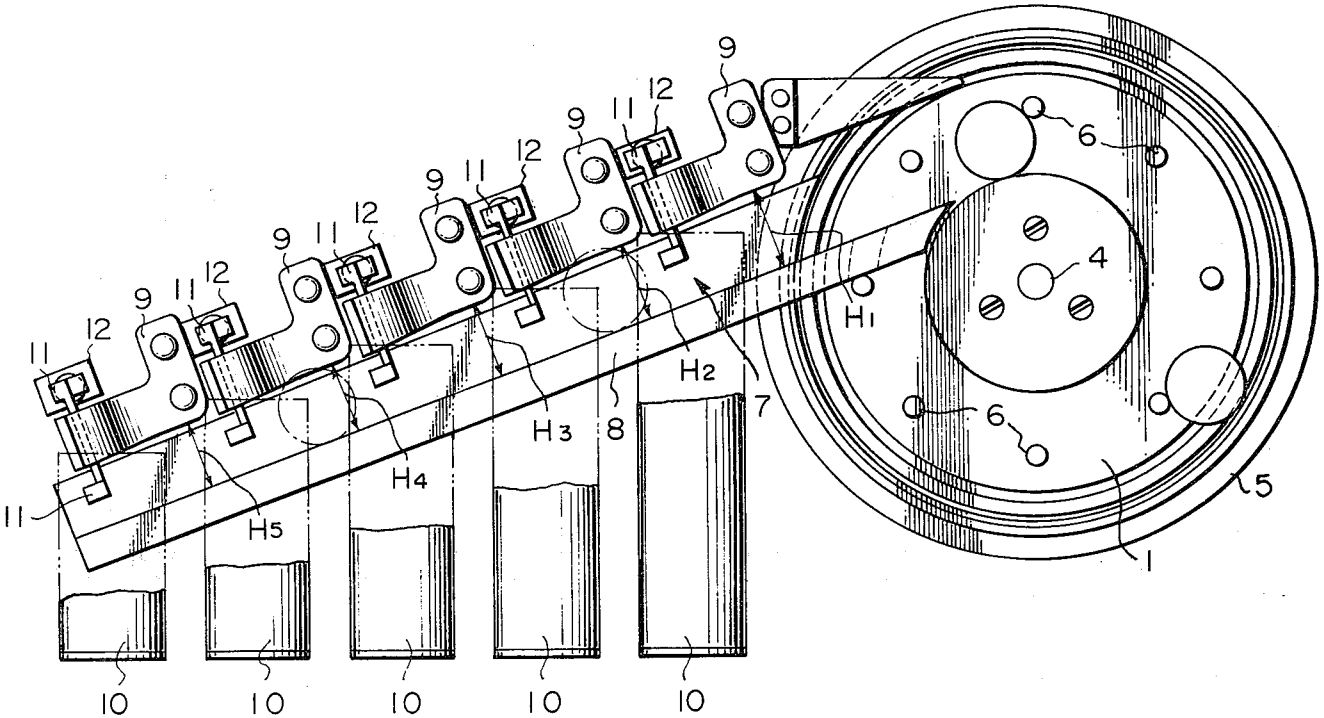
FIG. 2 is a diagrammatic side elevated view of FIG. 1.
Figure 3:
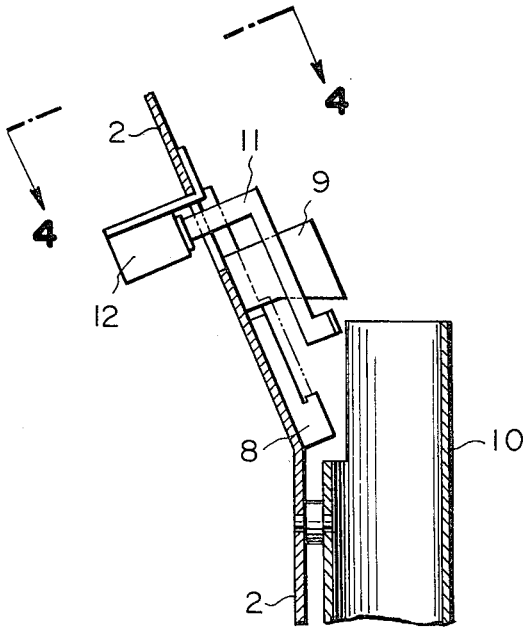
FIG. 3 is a side view of FIG. 2.
Figure 5:
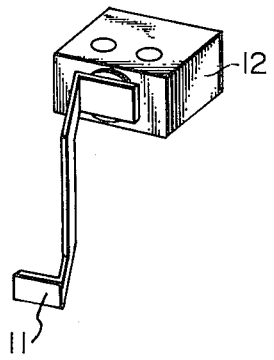
FIG. 5 is a perspective view showing a vibrating element and a vibration sensor.
Figure 4:
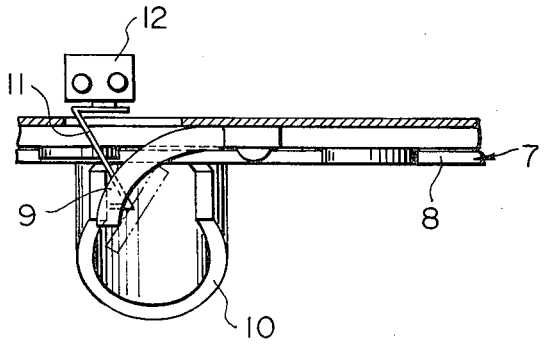
FIG. 4 is a top plane view seen from the direction of lines 4—4 of FIG. 3.

The present invention will be described in detail in the following in connection with one embodiment thereof with reference to the accompanying drawings. Indicated at reference numeral 1 is a rotary disc, which is inclined with respect to a body 2 such that it is turned by the driving force transmitted from a motor 3 through a shaft 4. On the other hand, the aforementioned rotary disc 1 has its outer circumference surrounded by an outer wall 5 and its surface formed by a plurality of such lands 6 as are made engageable with coins one by one thereby to scoop them up to the upper portion of the slope. Moreover, a coin path 7 is provided generally tangentially of the surface of the aforementioned rotary disc 1. In this coin path 7, there are arranged both a rail 8, which is so inclined as to allow the coins to roll in slightly inclined positions, and a plurality of guide members 9 for guiding the respective kinds of the coins (e.g., 100 Yens, 50 Yens, 10 Yens, 5 Yens, and 1 Yen) in accordance with the sizes or diameters thereof. The aforementioned guide members 9 are disposed above the aforementioned rail 8 and are shaped into a generally arcuate plate so that the coins change their courses and leave the track of the rail 8 along the aforementioned arcuate surface, when their circumferential edges come to abut against the guide members, until they are guided into respective chutes 10. More specifically, the guide members 9 are disposed at distances $H_1$, $H_2$ . . . $H_5$ from the rail 8 from the righthand side, as viewed in FIG. 2. The relationship between those distances ($H_1$, $H_2$ . . . $H_5$) and the diameters of the coins is as follows: The diameter of the largest coin is greater than the distance $H_1$, the distance $H_1$ is greater than the diameter of the second largest coin, the diameter of the second largest coin is greater than the distance $H_2$, and the like. Therefore, the first guide member 9 can select only the largest coin and guides it into the chute 10. In similar manner, the other guide members 9 select the corresponding coins, respectively. Incidentally, these chutes 10 are so arranged that the respective coins of 10 Yens, 100 Yens, 5 Yens, 50 Yens and 1 Yen are guided into the chutes 10 in the order of their diameters from the righthand side, as viewed in FIG. 2.

In the vicinities of the aforementioned guide members 9, on the other hand, there are arranged at a suitable spacing a plurality (i.e., the same number of the guide members 9 or the chutes 10) of vibration sensors 12 which are connected with vibrating elements 11, respectively. More specifically, each of these vibrating elements 11 is so arranged as to have its leading end slightly protruding into the inside of the arcuate surface of the corresponding guide member 9 and to be vibrated by the coin which is selected to come along the aforementioned corresponding guide member 9. On the other hand, each of the aforementioned vibration sensors 12 made operative so as to convert the vibrations of the corresponding vibrating element 11 into electric signals. For converting the vibrations of the vibrating element 11 into the electric signals, elements such as a condenser microphone, a piezoelectric element (e.g., a rock crystal or a crystal of Rochelle salt), and piezoelectric rubber can be used as vibration sensors. Specifically, the aforementioned condenser microphone is made operative to detect the vibrations of the aforementioned vibrating element 11 in terms of the electric signals by converting the vibrations into the changes in an electric capacity. On the other hand, the aforementioned piezoelectric element is made operative to detect the aforementioned vibrations in terms of the electric signals by converting the vibrations into the changes in a voltage. Moreover, the aforementioned piezoelectric rubber is made operative to detect the aforementioned vibrations in terms of the electric signals by converting the vibrations into the changes in an electric current.

Incidentally, the calculating means is made responsive to the electric signals from the aforementioned vibrations sensors 12 for calculating and indicating the numbers and sums of the coins of different kinds.

Now, the operations of the coin sorting and counting apparatus having the construction thus far described will be described in the following. When the mixed coins are supplied into the rotary disc 1 and this disc 1 is turned by the motor 3, then they are scooped up by the lands 6 and introduced into the coin path 7. The coins thus introduced into the coin path 7 roll downhill on the rail 8 by their own weights. The respective kinds of the coins are so guided, when they come into contact with their corresponding guide members 9, that they leave the track of the aforementioned rail 8 and are introduced into their corresponding chutes 10. Here, the description is limited, by way of example, to the case, in which the 50 Yen coin is supplied into the aforementioned coin path 7. In this case, since the 50 Yen coin has a diameter smaller than those of the 10 and 100 Yen coins, it is not guided by the guide members 9 for the 10 and 100 Yen coins but separated from the track of the rail 8 by the third guide member 9 from the right-hand side, as viewed in FIG. 2, until it moves along the inner arcuate surface of that particular guide member 9. In this way, when that 50 Yen coin moves along the arcuate surface of the guide member 9 so that it abuts against the corresponding vibrating element 11 which protrudes into the inside of that particular guide member 9, this vibrating element 11 is vibrated so that the corresponding vibration sensor 12 generates the electric signals confirming that the 50 Yen coin has been poured into the corresponding chute 10. As a result, the kinds of the coins, the numbers and sum of the coins of the different kinds, the total money and so on can be known by the use of the well-known calculating means.

As coin selecting and counting apparatus, incidentally, there is known apparatus of the type in which the rotary disc and the coin path (or the selecting path) are horizontally arranged and in which the coins are made to move by a belt mechanism disposed above the aforementioned coin path, whereby the coins in their moving courses are guided in succession in the order of the smaller diameter to the outside of the coin path so that they may be classified and counted (as is disclosed in Japanese Patent Laid-Open Patent Publication No. 54-25798). There is also known the apparatus of the type similar to the embodiment, in which the coins are successively dropped in the order of the smaller diameter (as is disclosed in Japanese Patent Publication No. 45-34084). There is further known the apparatus of the type, in which the so-called "sorting drum" is used (as is disclosed in Japanese Laid-Open Patent Publication No. 50-53098). The present invention can be applied without any difficulty to all the aforementioned coin sorting and counting apparatus. In other words, it is sufficient for the effects similar to the aforementioned ones that the aforementioned vibrating elements be so arranged as to contact with the coins falling down.

As has been described in detail hereinbefore, according to the present invention, the coins sorting and counting apparatus is so constructed that the vibrating elements protruding into the insides of the respective guide members are connected with the respective vibration sensors, that the coins come into contact with the aforementioned vibrating elements, while being guided along the aforementioned guide members, thereby vibrate the vibrating elements, and that the resultant vibrations are converted into electric signals by the aforementioned vibration sensors. Thus, the coin sorting and counting apparatus according to the present invention is not affected by dust so that it is free from any erroneous counting operation, which feature is different from the photoelectric detector according to the prior art. Moreover, the apparatus of the present invention can accomplish the coin counting operation stably and reliably for a long time period although it is simply constructed and attached.

What is claimed is:

1. A coin sorting and counting apparatus which comprises a coin guiding and sorting mechanism for guiding coins to be sorted and for sorting coins by changing the guided coins' courses at predetermined positions according to the sizes of the coins, a coin feeding mechanism for feeding the coins to the coin guiding and sorting mechanism one by one, and a counting device arranged along the coin guiding and sorting mechanism including a plurality of vibrating elements for being vibrated by the coming coins when the latter come into contact with the former and arranged at the respective positions where the coins change their course, a plurality of vibration sensors connected with the vibrating elements, respectively, for converting the vibrations of said vibrating elements into electrical signals, and calculating means responsive to the electric signals for separately calculating the numbers of the coins having the different sizes.

2. A counting device according to claim 1, wherein each of said vibrating elements has its leading end so slightly protruding into the corresponding branch, through which the sorted coin of one size changes its course, as to abut against said sorted coin.

3. A counting device according to claim 1, wherein each of said vibration sensors includes a condenser microphone for detecting the vibrations of the corresponding vibrating element in terms of said electric signals by converting said vibrations into changes in electric capacity.

4. A counting device according to claim 1, wherein each of said vibration sensors includes a piezoelectric element for detecting the vibrations of the corresponding vibrating element in terms of said electric signals by converting said vibrations into changes in a voltage.

5. A counting device according to claim 1, wherein each of said vibration sensors includes a piezoelectric rubber for detecting the vibrations of the corresponding vibrating element in terms of said electric signals by converting said vibrations into changes in electric current.

* * * * *